United States Patent [19]

Conforti

[11] 3,970,269

[45] July 20, 1976

[54] ARITHMATIC CIRCUIT FOR BANG-BANG SEEKERS

[75] Inventor: Robert F. Conforti, Thousand Oaks, Calif.

[73] Assignee: Hughes Aircraft Company, Culver City, Calif.

[22] Filed: Jan. 6, 1975

[21] Appl. No.: 538,841

[52] U.S. Cl. ..... 244/3.16; 250/203 R

[51] Int. Cl.[2] ..... F41G 7/00

[58] Field of Search ..... 244/3.13, 3.16, 3.17, 244/3.18; 250/20 RR, 578

[56] References Cited

UNITED STATES PATENTS 3,494,576 2/1970 Lamelot ..... 244/3.16

3,657,547 4/1972 Mansfield ..... 250/203 R

*Primary Examiner*—Samuel Feinberg

*Attorney, Agent, or Firm*—Rafael A. Cardenas; William H. MacAllister

[57] ABSTRACT

A system for guiding a missile to a target is disclosed which includes a signal processor for generating error signals in response to a signal being received from the target. The processor includes four channels for receiving a target signal. An arithmatic circuit compares the amplitude of the target signal on each channel with the average amplitude of the other three channels and generates an error signal for guiding the missile.

2 Claims, 7 Drawing Figures

ARITHMATIC CIRCUIT FOR BANG-BANG SEEKERS

FIELD OF THE INVENTION

This invention relates generally to missile guidance systems for tracking a laser light illuminated target. In particular, this invention relates to a guidance system for receiving signals of reflected laser energy from a target and generating eight missile command steering signals.

DESCRIPTION OF THE PRIOR ART

Guiding a missile to a target by illuminating the target with laser energy and utilizing the reflected laser energy to generate missile commands is generally known in the prior art. Typically, field personnel illuminate a target with laser energy and nearby aircraft, carrying guided missiles, scan the terrain and locate the laser illuminated target by the reflected laser energy. An infrared detector on the missile nose cone is directed at the target and the missile is fired at the target when the target is within the range of the missile. The missile is guided to the target by error signals generated by a laser signal processor.

Generally, an optical system receives the laser energy reflected by the target and that laser light is focused to a small spot on an infrared quadrant detector. The infrared quadrant detector provides an output signal from the quadrant or quadrants upon which the spot of laser radiation falls. An analog processor coupled to the ouput terminals of the quadrant determines the location of the radiation spot and an error signal is generated. Appropriate missile steering commands are generated in response to the error signals. One such guidance system is commonly called a "bang-bang" seeker system which generates a steering command to direct the missile so that the small spot moves to a second, diagonally opposite quadrant on the quadrant detector. As the spot is detected on the second quadrant, new error signals are generated which results in spot moving back to the first quadrant. Steering commands are thus generated, until impact of the missile, in a fashion that the missile oscillates about a center line from the missile to the target.

One such "bang-bang" seeker system utilizes a "paired sum differencing" circuit which determines whether the radiation spot lies in the upper or lower half of the field of view of a quadrant detector and the relative strengths of those signals are compared. The system also determines whether the spot lies in the right half or left half of the field of view and the relative strengths of those signals. Thus, in a paired sum differencing system, every steering command consists of a combination of an up-down signal and a right-left signal. With such a seeker system, only four possible steering commands are generated irrespective of the location of the radiation spot relative to the center of the quadrant array. Since the noise of all four channels is processed for one output signal, there is four times the noise and the signal-to-noise ratio is degraded by a factor of 0.5 from that of a single channel output signal having only noise from one channel.

Another bang-bang seeker system is the "diagonal differencing" system which generates steering commands by comparing the signal strengths of the radiation centroid in diagonally opposite quadrants and generates commands which steer the missile toward the quadrant having the smaller signal. Since only two channels are involved in each decision, the long range signal-to-noise ratio is degraded to a factor of 0.707 of the maximum obtainable value from a single channel. When the radiation centroid of the spot is well-removed from the center of the quadrant array, the spot falls in one and possibly two quadrants which results in eight possible steering commands being generated. When the centroid of the radiation spot lies close to the quadrant array center only four diagonally opposed steering commands can be generated since two or more quadrants receive the infrared energy. Also, as the missile approaches the laser illuminated target the laser beam subtends a greater angle on the optics. Thus, as the missile approaches the target the radiation spot on the quadrant detector grows in diameter. The spot growth creates an ambiguous region since the spot falls on several quadrants. To minimize the spot growth problem, some systems utilize two processing schemes, one for long range and one for short range. The long range processor uses the output of the individual channels or quadrants to generate steering commands since the spot lies entirely in one quadrant of the detector. The short range processor weighs the signal strength in diagonally opposite channels when the missile is close to the target and the spot size has grown so that the radiation spot falls on two quadrants.

SUMMARY OF THE INVENTION

Accordingly, it is the object of the present invention to provide a simple, reliable and accurate guidance system for guiding a missile to target.

It is another object of the present invention to provide a bang-bang seeker guidance system which has a signal-to-noise factor of 0.866 over that of a single channel.

It is yet another object of the present invention to provide a bang-bang seeker guidance system that provides eight steering commands in both the inner and outer zones of a quadrant detector.

It is still another object of the present invention to provide a missile guidance system that provides more refined missile steering signals.

In accordance with the foregoing objects, a missile guidance system includes an arithmatic circuit for receiving a plurality of input signals on a plurality of channels, respectively, each channel defining a section of space. The signal on each channel is compared with the average of the sum of the signals on the remaining channels. The arithmatic circuit provides an output signal from the channel or channels having the greatest signals.

DETAILED DESCRIPTION OF THE DRAWINGS

Figure 1:
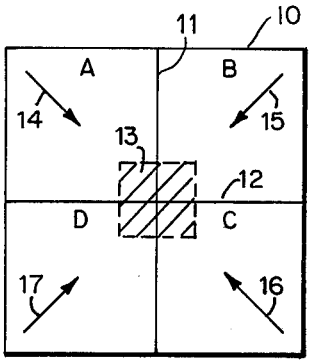
FIG. 1 is a schematic representation of the steering commands generated by one of the prior art missile guidance systems.

Referring more specifically to the drawings, a prior art processor utilizing a "bang-bang" seeker system generates steering commands illustrated in FIG. 1. The herein described system includes a paired sum differencing circuit. The detector 10 has four quadrants A, B, C and D in a clockwise direction commencing at the upper lefthand quadrant. The lines 11 and 12 are the boundary lines between the four quadrants. The square 13 represents the inner zone of the quadrant detector while the area outside the square 13 represents the outer zone. The significance of the distinction of inner-outer zones is developed below in FIG. 2.

The laser energy reflected by a target is focused to a small spot on the infrared detector 10 by suitable optics, not shown. The quadrant receiving the radiation provides an output signal to the paired sum differencing circuit coupled to the detector 10. The vectors 14, 15, 16 and 17 represent the steering commands generated by the processor if the radiation spot falls within the respective quadrants A, B, C, or D. For example, if the radiation spot falls entirely within quadrant A of the detector 10, a positive elevation error signal and a negative azimuth error signal are generated. This results in a negative elevation steering command and a positive azimuth steering command signal being generated, illustrated here as a diagonal vector 14. When the center of the spot is within its radius of the center of the detector 10, output signals occur at all four quadrants. Thus, there is no useful steering information generated and the seeker has a "dead zone" which is equal to the spot radius. In certain situations, such as the terminal phase of missile guidance, the dead zone may be undesirably large.

The algorithm which describes the steering commands, S, generated by a processor of the paired sum differencing type is $$S = S_{AZ} + S_{el},$$

where $S_{AZ}$ is the azimuth signal, and $S_{EL}$ is the elevation signal which results in a diagonal vector such as 14–17.

The azimuth component of each steering command is:

$$S_{AZ} = (A+B) - (C+D).$$

The elevation component of each steering command is:

$$S_{EL} = (B+C) - (A+D).$$

Thus for each steering command S there are four signals that must be utilized.

Since the signal from each quadrant of the detector 10 must be utilized to generate a missile steering command, the noise from all four quadrants is also contained in each steering signal. The long range signal-to-noise ratio is given by $$\frac{S}{(N_A^2+N_{B\ 2}+N_C^2+N_D^2)^{1/2}} = 0.5\ \frac{S}{N_1},$$

where S is the signal amplitude and $N_A$ is the noise amplitude associated with one channel represented by quadrant A, $N_B$ is the noise amplitude associated with quadrant B, etc., and $N_A = N_B = N_C = N_D = N_1$.

Thus, it is apparent that the signal-to-noise ratio is degraded to 50% of the signal-to-noise ratio of any individual channel as represented by $N_1$.

Elements or components in subsequent figures that are the same or similar to elements or components in FIG. 1 will have the same reference designation numerals.

Figure 2:
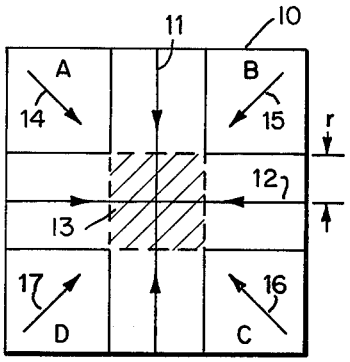
FIG. 2 is a schematic representation of the steering commands generated by another prior art missile guidance system.
Figure 4:
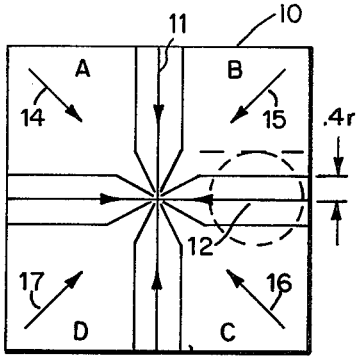
FIG. 4 is a schematic representation of the steering commands generated by the present invention.

Referring now to FIG. 2, the steering commands generated by a prior art "bang-bang" seeker having a diagonal differencing circuit are herein described. The detector 10 has four quadrants A, B, C and D. The square 13 represents the inner zone having a side length of $2r$ where $r$ represents the radius of the radiation spot on the detector 10.

The algorithm which defines the steering command, S, generated by a processor utilizing a diagonal differencing circuit is $S = \delta_{AC} + \delta_{BD}$, where $\delta_{AC}$ is the diagonal steering component between quadrants A and C, and $\delta_{BD}$ is the diagonal steering component between quadrants B and D.

The processor algorithm which describes the first diagonal component, $\delta_{AC}$, of a command signal is $$\delta_{AC} = A - C,$$

where A is a signal received on quadrant A and C is the signal received in quadrant C of the detector 10.

The algorithm which describes the second diagonal component ($\delta_{BD}$) of a command signal is:

$$\delta_{BD} = B - D,$$

where B is a signal received on quadrant B and D is a signal received on quadrant D.

The diagonal differencing scheme compares signal strengths in diagonally opposite quadrants and generates steering commands which steer the missile toward the quadrant having the smaller signal.

Steering signals are generated as follows:

Positive azimuth: if $\delta_{AD}$ is positive or $\delta_{BC}$ is negative;
Negative azimuth: if $\delta_{AD}$ is negative or $\delta_{BC}$ is positive;
Positive elevation: if $\delta_{AD}$ is positive or $\delta_{BC}$ is positive; and
Negative elevation: if $\delta_{AD}$ is negative or $\delta_{BC}$ is negative.

Eight steering commands are possible if the centroid of the radiation spot falls in the outer zone of the quadrant detector 10. For example, if the spot's centroid lies entirely in quadrant A, a command to steer toward the diagonally opposite quadrant C is generated. Since there are four quadrants, there are four possible diagonal steering commands. If the spot lies in two quadrants such as A and B, two steering commands toward diagonally opposite quadrants, i.e., C and D, are generated. The vector sum of these two steering commands is a vector along a line parallel to the boundary between the two quadrants A and B. Since there are four boundary lines, there is a possibility of four commands when the radiation spot falls in the outer zones of two quadrants. Thus eight different steering commands are possible when the centroid of the spot lies in the outer zone of the detector array.

As described above, the inner zone 13 consists of a square centered about the quadrant detector and having sides with a length of $2r$ and $r$ is the radius of the radiation spot on the detector 10. If the centroid of the spot lies within the inner zone, at least three quadrants are illuminated and two steering commands are always generated so that the net command is directed along one of the lines 11 or 12 dividing the array. The direction of the net command is determined by the location of the spot's centroid in relation to a line drawn at 45° through the center of the array. For example, if the centroid of the spot falls in the A quadrant of the detector 10 between the 45° line and the boundary line 12, the resultant steering vector will be along the boundary line 12.

Therefore, it can be seen that there are only four possible steering commands if the spot falls entirely within the inner zone. If the spot is centered over the center of the detector array 10, i.e. $\delta_{AD} = \delta_{BC} = 0$ then the error signals are zero and no steering commands are generated.

The long range signal-to-noise ratio is given by $$\frac{S}{(N_A^2 + N_B^2)^{1/2}} = 0.707 \quad \frac{S}{N_1}.$$

Thus it is apparent that the signal-to-noise ratio of a diagonal differencing circuit is degraded by only 30% over the signal-to-noise ratio of a single channel.

Figure 3:
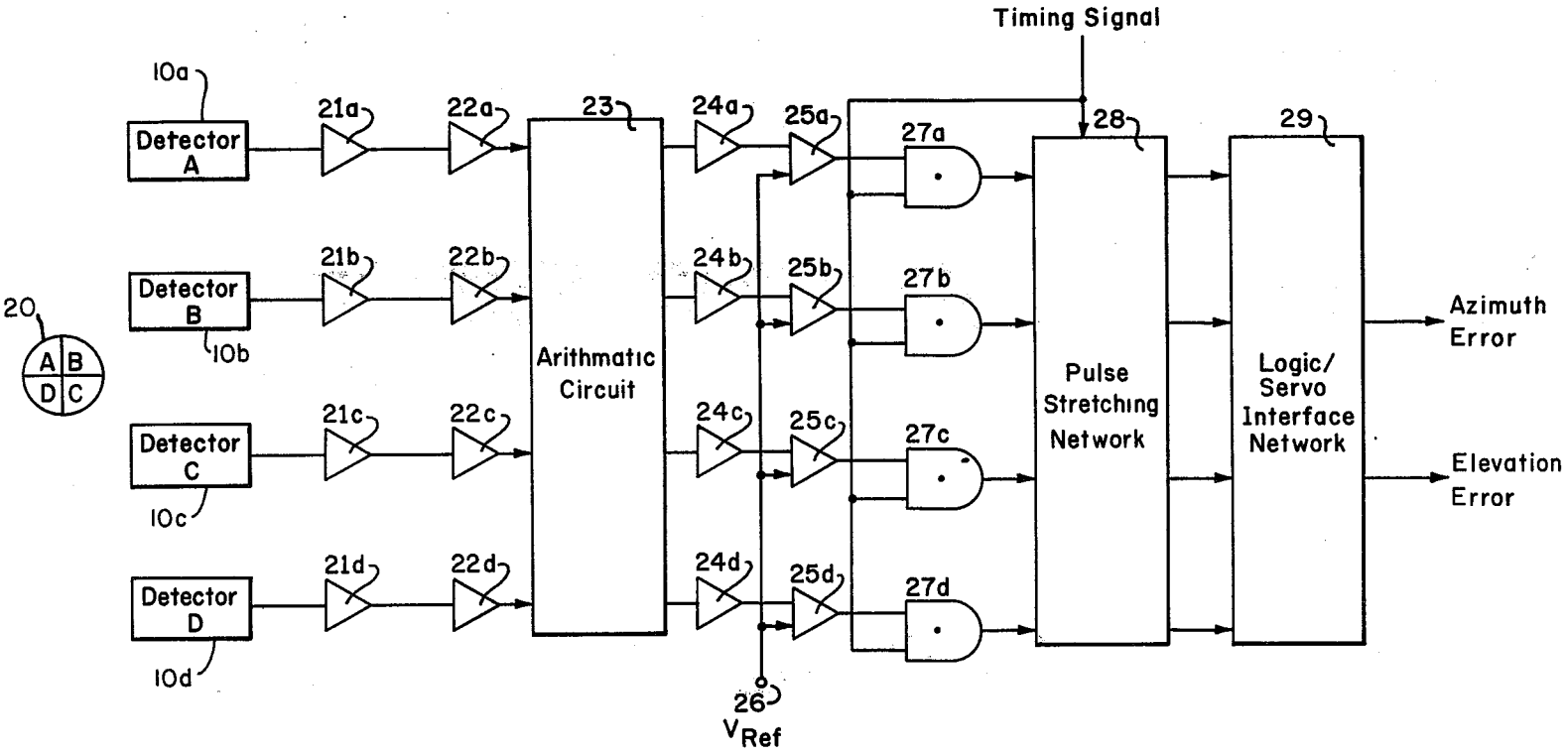
FIG. 3 is a schematic circuit diagram of a missile guidance system utilizing the present invention.

Referring now to FIG. 3, first embodiment of a laser analog processor according to the present invention is described. The primary function of a laser signal processor is to process the four quadrant detector return signals throughout the missile flight and generated bang-bang steering commands for an auto pilot to guide the missile. For performing these primary functions, the signal processor is composed of two major subsystems an analog processor, herein described, and a digital processor which is not described herein. The processor includes an optic system 20 for receiving laser energy and focusing that energy to a small spot on an infrared quadrant detector 10. Each quadrant of the quadrant detector 10 provides an input means for separate video channels hereinafter designated as channels, A, B, C and D. The quadrant detector 10 is illustrated as a circular array 20 with the quadrants being numbered clockwise from the upper left hand quadrant. Detector quadrant 10A, is coupled to a preamplifier 21*a* which in turn is coupled to a first video amplifier 22*a*. The preamplifier 21*a* amplifies the output current from quadrant A. The output of the first video amplifier 22*a* is coupled to the first input channel of the arithmatic circuit 23.

Channel B includes a preamplifier 21*b* coupled between quadrant B and a video amplifier 22*b*. Channel C includes a preamplifier 21*c* coupled between quadrant C and a video amplifier 22*c*. Channel D includes a preamplifier 21*d* coupled between quadrant D and a video amplifier 22*d*. The preamplifiers 21*b*–21*d* are similar to the preamplifier 21*a*. The video amplifiers 22*b*–22*d* are similar to the video amplififer 22*a*. The output terminals of the video amplifiers 22*b*–22*d* are coupled to the arithmatic circuit 23.

The arithmatic circuit 23 provides four output terminals, one for each channel, and the output signals are designated as A′, B′, C′ and D′. Channel A of the arithmatic circuit 23 is coupled to a second video amplifier 24*a*. Channels B, C and D of the arithmatic circuit 23 are coupled to second video amplifiers 24*b*, 24*c* and 24*d*, respectively. The arithmatic circuit 23 is a three-channel average differencing circuit which selects those channels having the greatest signal amplitudes for generating a steering command. The algorithms which describe the function of the arithmatic circuit 23 are:

$$A' = A - \frac{B+C+D}{3},$$

$$B' = B - \frac{A+C+D}{3},$$

$$C' = C - \frac{A+B+D}{3}, \text{and}$$

$$D' = D - \frac{A+B+C}{3},$$

where A, B, C and D are the input signals from the video amplifiers 22*a*–22*d* and A′, B′, C′ and D′ are the output signals.

Briefly, the operation of the arithmatic circuit 23 is as follows. When the image is centered, i.e., all quadrants receive the same input signals, the three-channel average difference output signals are zero and no steering information is generated. However, for small displacements in the image, positive steering signals are generated by only one channel. For example, if the energy in quadrant A increases by δ over the energy in the diametrically opposite quadrant D, the output signals from the arithmatic circuit 23 are:

$$\Delta A' = \frac{4\delta}{3}; \ \Delta B' = O; \ \Delta C' = O; \text{ and } \Delta D' = \frac{-4\delta}{3}.$$

since the adapter threshold is set such that only positive signals from the arithmatic circuit 23 are passed by the comparator circuits 25, then only the A′ signal crosses the positive threshold. The threshold crossing of the channel A threshold results in a negative elevation command and a positive azimuth command being generated, i.e. toward quadrant C. The combined elevation and azimuth commands drive the seeker in a 45° direction to center the target centroid within the field of view. In cases where the image displacement is such that positive signals are generated by more than one channel, the steering signals will be derived by the vector sum of the outputs.

The output terminal of the second video amplifier 24*a* is coupled to one input terminal of a comparator 25*a*. The other input signal to the comparator 25*a* is supplied by a positive reference voltage ($V_{Ref}$) at terminal 26. The comparator 25*a* provides an output signal pulse whenever the threshold level set by the reference voltage has been exceeded by the signal A′, from the second video amplifier 24*a*. The output terminal of the comparator 25*a* is connected to one input terminal of an AND gate 27*b*. A comparator 25*b* is coupled between the second video amplifier 24*b* and one input terminal of an AND gate 27*b*. A comparator 25*c* is connected between the second video amplifier 24*c* and input terminal of an AND gate 27*c*. A comparator 25*d* is coupled between the second video amplifier 24*d* and one input terminal of an AND gate 27*d*. The comparators 25*b*–25*d* are similar to the comparator 25*a*. The second input terminals of the comparators 25*b*–25*d* are also coupled to the positive reference voltage at terminal 26. The second input terminals of the AND gates 27*a*–27*d* receive a clock pulse from a circuit not shown for passing the comparator output pulse. The output terminals of the AND gates 27*a*–27*d* are coupled to the input terminals of a pulse stretching circuit 28. The pulse stretching circuit 28 is implemented by using a bank of four high-speed flip-flops, one flip-flop for each channel. All the flip-flops are set up on a pulse being received from any of the AND gates 27*a*– 27*d*. The pulse-stretching circuit 28 stores a signal indicating that one or more quadrant thresholds have been crossed.

The four output channels of the pulse stretching circuit 28 are coupled to a logic/servo interface circuit 29 which provides the azimuth steering command signal and the elevation steering command signal to the servo electronics (not shown). The logic/servo interface 29 converts the four quadrant pulse digital signals to orthogonal elevation and azimuth steering signals. For example, to generate the azimuth steering signal, namely, AZ = (B OR D) (A OR C), the outputs of channels A and C are logically ORed and the resultant subtracted from the logical OR of channels B and D. A similar mechanization is used to generate the elevation steering signal, i.e., EL = (A OR B) (C OR D). Hence, if a signal appears on channel A, a positive elevation command and a negative azimuth command will be generated. Also, if output signals occur in more than one channel, the vector sum of the outputs, as defined by the azimuth and elevation steering equations, will be utilized to generate the steering signals.

The operation of the invention according to FIG. 3 is now described. As discussed above, the primary functions of a laser signal processor are to provide automatically tracking of a target by a laser target return pulse and the generation of steering commands to the missile.

An infrared signal is detected by one or more of the quadrants A, B, C or D, of the quadrant detector 10, which signal is applied to the preamplifiers 21*a*–22*d* and then to the first video amplifiers 22*a*–22*d*.

Figure 5:
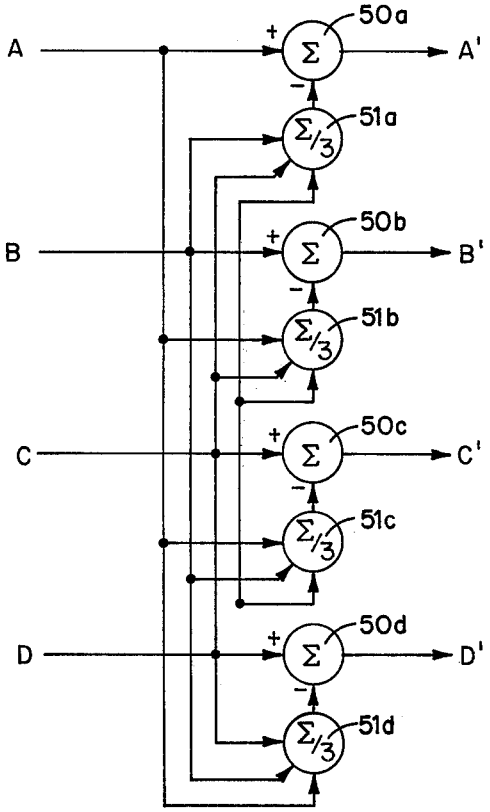
FIG. 5 is a schematic block diagram of an arithmatic circuit transformation for a quadrant detector according to the present invention.

Referring now to FIG. 5, a three quadrant average differencing circuit may be represented as the following transform. The input signals to the four channels are represented by A, B, C and D while A′, B′, C′ and D′ represent the output signals. Although only channel A is discussed, channels B, C and D are similar to channel A. Channel A includes first and second summing networks 50*a* and 51*a*, respectively. The summing network 50*a* has two input terminals and one output terminal. The first input terminal is coupled to the channel A of quadrant 10 while the second input terminal is coupled to the output of the second summing network 51*a*. The output of the summing network 50*a* provides the A′ output signal of the differencing circuit. The summing network 50*a* subtracts the output signal of the summing network 51*a* from the input signal on channel A and thereby provides the A′ signal output.

The second summing network 51*a* has input terminals for receiving the channels B, C and D signals from their respective quadrants on the quadrant detector 10. These three input signals are added together and divided by three to arrive at an average signal which will be supplied to the first summing network 50*a*.

This signal processing scheme compares the signal on any quadrant to the average of the signals occurring in the other three quadrants and from the following equation of signal-to-noise ratio, it can be seen that the signal-to-noise degradation factor is 0.866:

$$\frac{S}{N_A^2 + \frac{N_B^2+N_C^2+N_D^2}{9}^{1/2}} = 0.866 \quad \frac{S}{N}$$

where S is the long range signal and $N_A$-$N_D$ represents the noise amplitude of channels A-D, respectively. Since the noise associated with three of the quadrants is weighted by a factor of one third, the signal-to-noise degradation is therefore improved over either the paired sum differencing techniques and the diagonal differencing techniques discussed above.

Another improvement of the present invention over prior systems is that more refined steering information is provided for guiding the missile during the terminal stage of the flight and this advantage is depicted in FIG. 5. As discussed above, the signal processor using the diagonal differencing technique, provides eight possible steering commands when the centroid of the spot lies in the outer zone of the quadrant detector. As the centroid of the spot traversed into the inner zone, only four steering commands could be generated. It should be recalled that the inner zone was a square centered about the center of the quadrant detector and having sides equal to twice the radius of the spot centroid. With the present invention, the dividing line between steering commands occurs a distance of plus or minus 0.4*r* from the dividing line between quadrants due to the one third averaging factor. For example, a centroid falling across detector quadrants B and C and covering 0.4*r* of the distance both above and below the division line between the quadrants will generate a steering command along that division line. If the spot centroid falls outside of the 0.4 *r* distance from the dividing line and in the B quadrant, then a steering command corresponding to the vector B will be generated. The division line between steering commands remains parallel to the dividing line between detector quadrants until the centroid of the spot comes within a distance or from the edge of the third quadrant. As the spot moves closer toward the center of the array, the division line between steering commands also moves toward the center of the array. Thus, eight possible steering commands are generated in the inner zone as well as the outer zone of the quadrant detector.

Figure 6:
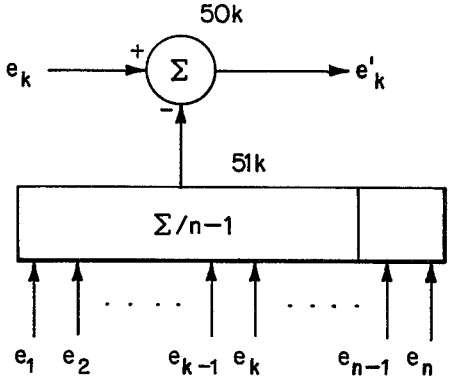
FIG. 6 is a schematic block diagram of an arithmatic transformation for a detector having $n$ sections.

FIG. 6 depicts the transformation for the Kth channel of an *n* section detector. The Kth channel includes first and second summing circuits 50K and 51K, respectively. The first summing circuit 50K has two input terminals and an output terminal. The first input terminal is coupled to the K channel detector and the output terminal provides the K′ output from the circuit. The second summing circuit 51K provides N-1 input terminals for coupling to the detector channels other than the K channel. The average of all the input signals to the second summing circuit 51K is the output from the second summing network 51K and is coupled to the second input terminal of the first summing circuit 50K.

Figure 7:
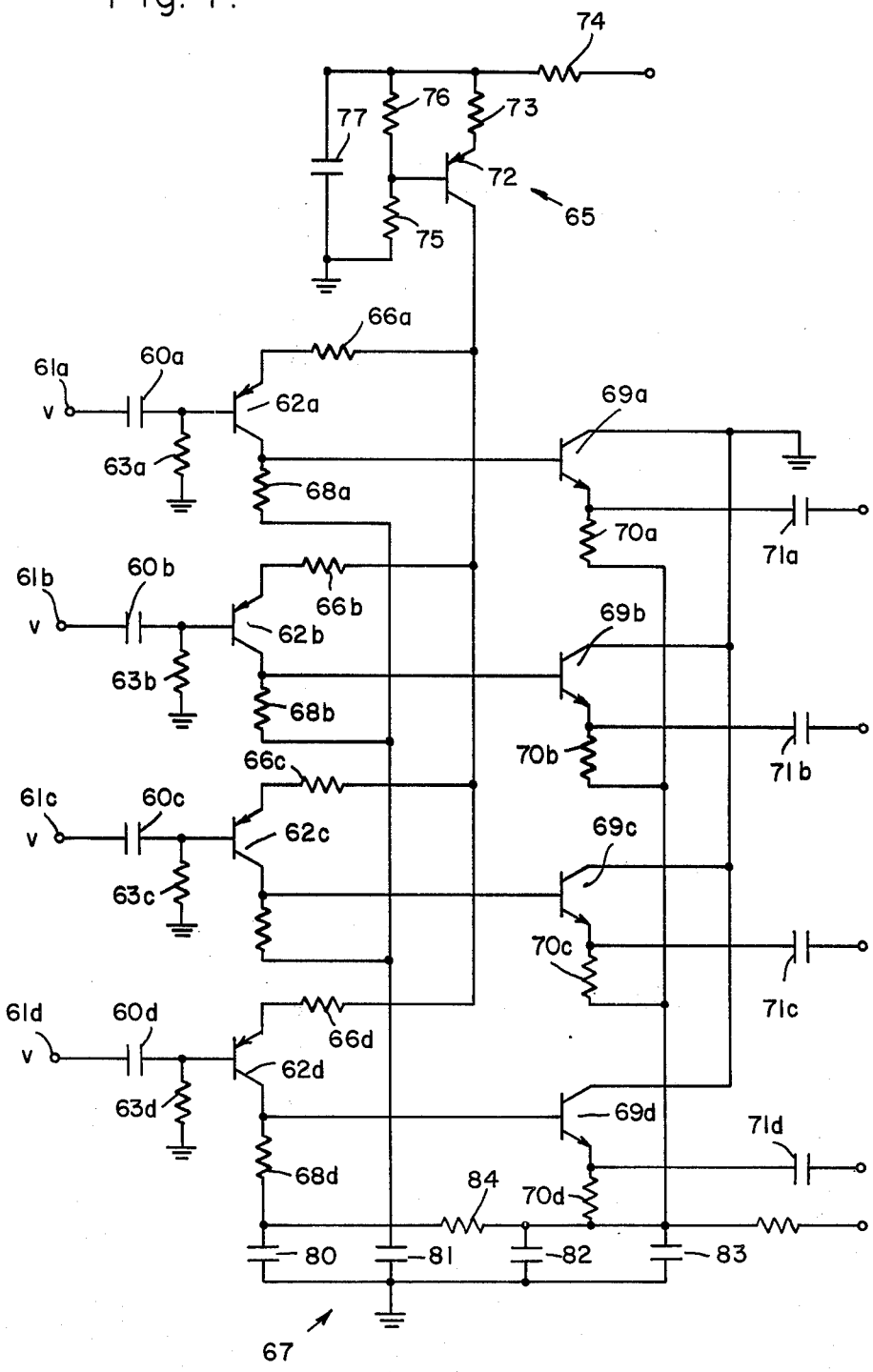
FIG. 7 is a schematic circuit diagram of an arithmatic circuit.

An implementation of a four channel arithmatic circuit is now described in FIG. 7. Channel A includes a coupling capacitor 60*a* being connected between an input terminal 61*a* and the base of a transistor 62*a*. A biasing resistor 63*a* is coupled between the base of transistor 62*a* and a reference level voltage. The emitter is coupled to a current source 65 by a biasing resistor 66*a*. The collector is coupled to a decoupling network 67 by a biasing resistor 68*a*. The collector of the transistor 62*a* is also connected to the base of a buffer transistor 69*a*. The collector of the NPN transistor 69*a* is connected to a reference voltage. The emitter of transistor 69*a* is coupled to the decoupling network 67 via a biasing resistor 70*a* and to an output terminal via a coupling capacitor 71*a*.

Channels B, C and D are identical to channel A and will therefore not be discussed.

The current source 65 includes a PNP transistor 72 having the emitter electrode coupled to a positive voltage by series connected biasing resistor 73 and a decoupling resistor 74. The collector is connected to the emitter biasing resistors of transistors 62*a*–62*d* of channels A-D, respectively. The base of the transistor 72 is coupled to a reference voltage by a biasing resistor 75. A biasing resistor 76 connects the resistor 74 to the base of transistor 72. A decoupling capacitor 77 is connected between the junction of resistors 73 and 74 and the reference voltage.

The decoupling network 67 includes capacitors 80 and 81, connected in parallel to each other, and coupled between the bias resistors 68*a*–68*d* and the reference voltage. Capacitors 82 and 83, connected in parallel to each other, are connected between the bias resistors 70*a*–70*d* and the reference voltage. A resistor 84 is coupled between the junction of capacitors 80 and 81 and the junction of capacitors 82 and 83.

In operation, an input signal, $V_A$, is applied to the channel A input terminal of the circuit of FIG. 7. An emitter current $I_{EA}$ is induced in transistor 62*a* such that $$I_{EA} = \frac{-V_A}{R_E + R_{63a} + {}^{1/3}(R_E + R_{63a})} = -\frac{3}{4}\,\frac{V_A}{R_E + R_{63a}}$$

where $R_E$ is the equivalent emitter resistance of the transistor 62*a* and $R_{63a}$ is the resistance of the resistor 63*a*. The current, $I_{EA}$, is divided symmetrically between the other three transistors, 63*b*, 63*c* and 63*d* so that:

$$I_{EB} = I_{EC} = I_{ED} = \frac{1}{4}\,\frac{V_A}{R_E + R_{63a}}$$

The voltages at the output terminals of the arithmatic circuit are then:

$$V_A' = -\tfrac{3}{4}\,\frac{R_{68a}}{R_E + R_{63a}} V_A = -3kV_A,\ k = \tfrac{1}{4}\,\frac{R_{68a}}{R_E + R_{63}}$$

$$V_B' = V_C' = V_D' = kV_A$$

where $R_{68a}$ is the resistance of the resistor 68*a*. The case where inputs are applied to all four channels simultaneously can be handled by superposition to give $$V_A' = -3k\,[V_A - \frac{V_B + V_C + V_D}{3}]$$

$$V_B' = -3k\,[V_B - \frac{V_C + V_D + V_A}{3}]$$

$$V_C' = -3k\,[V_C - \frac{V_D + V_A + V_B}{3}]$$

$$V_D' = -3k\,[V_D - \frac{V_A + V_B + V_C}{3}]$$

which is the desired relation. For the circuit shown $R_E \approx 15\Omega$ and therefore $k = 0.77$.

It should be apparent from the foregoing that the present invention provides a simple and reliable missile guidance system which provides for more accurate steering commands.

Although the present invention has been shown and described with reference to particular embodiments, nevertheless, various changes and modifications obvious to one skilled in the art to which this invention pertains are deemed to lie within the purview of the invention.

What is claimed is:

1. A missile guidance system comprising:

detector means having n detecting sections for receiving a signal from a target and generating output signals from any of said sections in response to said target signal;

arithmatic means coupled to said detector means said arithmatic means having *n* channels corresponding to said detector means sections, said arithmatic means for summing a signal of any channel with the average of signals on said other *n*-1 channels and providing an output signal from said channel having a signal greater than the average of said other signals; and command generating means coupled to said arithmatic means for providing output signals to steer said missile to said target in response to said arithmatic means.

2. A missile guidance system, comprising:

quadrant detector means for receiving a signal from a target, each of said quadrants for generating an output signal in response to said target signal;

arithmatic means having four channels respectively coupled to said quadrants of said quadrant detector said first channel for summing a first signal on said first channel and the average of the sum of signals on said other three channels and providing a signal from said channel having a signal greater than the average of said sum;

threshold means having four channels being respectively coupled to said channels of said arithmatic means, for providing an arithmatic signal whenever said signals from said means exceed a predetermined threshold;

reset means coupled to said threshold means, said reset means being responsive to a timing signal;

flip-flop means having four channels coupled to said reset means for providing a first signal in response to said threshold means, said flip-flop means being reset by said reset means and for providing a second signal in response to said threshold means; and means coupled to said pulse stretching means for providing steering signals.

* * * * *